US006719090B2

(12) United States Patent
Tracy

(10) Patent No.: US 6,719,090 B2
(45) Date of Patent: Apr. 13, 2004

(54) SPEAKER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 0 days.

(21) Appl. No.: 10/086,380

(22) Filed: Mar. 4, 2002

(65) Prior Publication Data

US 2003/0164263 A1 Sep. 4, 2003

(51) Int. Cl.[7] ..... H04R 1/02; H04R 1/20

(52) U.S. Cl. ..... 181/145; 181/199; 181/189; 381/335; 381/351

(58) Field of Search ..... 181/144, 145, 181/166, 199, 148, 190, 160; 381/335, 339, 345, 351, 82; D14/204, 205, 206, 210, 214

(56) References Cited

U.S. PATENT DOCUMENTS

| | | | | | |
|---|---|---|---|---|---|
| 4,051,919 | A | * | 10/1977 | Buettner | 181/144 |
| 4,256,922 | A | * | 3/1981 | Gorike | 181/144 |
| 4,417,170 | A | | 11/1983 | Benincasa | |
| 4,597,470 | A | * | 7/1986 | Takagi et al. | 181/144 |
| 4,696,369 | A | * | 9/1987 | Dodrill | 181/144 |
| 4,836,329 | A | * | 6/1989 | Klayman | 181/144 |
| 4,923,031 | A | | 5/1990 | Carlson | 181/144 |
| 4,993,510 | A | * | 2/1991 | Kato et al. | 181/141 |
| 5,210,793 | A | | 5/1993 | Carlson et al. | |
| 5,222,145 | A | | 6/1993 | Draffen | 381/24 |
| 5,258,584 | A | | 11/1993 | Hubbard | 181/147 |
| 5,321,756 | A | * | 6/1994 | Patterson, Jr. et al. | 381/335 |
| 5,430,260 | A | * | 7/1995 | Koura et al. | 181/144 |
| 5,514,841 | A | | 5/1996 | Rochon | 181/156 |
| 5,687,247 | A | * | 11/1997 | Proni | 381/398 |
| 5,818,950 | A | | 10/1998 | Sakamoto et al. | |
| 5,874,695 | A | * | 2/1999 | Tracy | 181/147 |
| 5,967,585 | A | | 10/1999 | Sprague | |
| 5,996,727 | A | | 12/1999 | Blind et al. | |
| 6,067,364 | A | | 5/2000 | Brinkley et al. | 381/396 |
| 6,098,743 | A | | 8/2000 | McGrath | 181/150 |
| 6,118,883 | A | | 9/2000 | Rocha | 181/387 |
| 6,215,884 | B1 | * | 4/2001 | Parrella et al. | 381/190 |
| 6,279,678 | B1 | | 8/2001 | Tracy | 181/144 |
| 6,282,298 | B1 | | 8/2001 | Azima et al. | 381/423 |
| 6,463,160 | B1 | * | 10/2002 | Tracy | 381/386 |
| 6,493,452 | B1 | * | 12/2002 | Koizumi et al. | 181/144 |

* cited by examiner

*Primary Examiner*—Robert Nappi
*Assistant Examiner*—Eduardo Colon Santana
(74) *Attorney, Agent, or Firm*—Welsh & Flaxman LLC

(57) ABSTRACT

The speaker assembly includes a speaker housing having a closed top wall and an opposed open end. The speaker assembly further includes a first sound source having a cone with an interior surface and an exterior surface. The first sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the first sound source. The speaker assembly also includes a second sound source having a cone with an interior surface and an exterior surface. The second sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the second sound source. The exposed portion of the first sound source faces a direction opposite the exposed portion of the second sound source to create stereo separation between the first and second sound sources.

18 Claims, 9 Drawing Sheets

FIG. 4
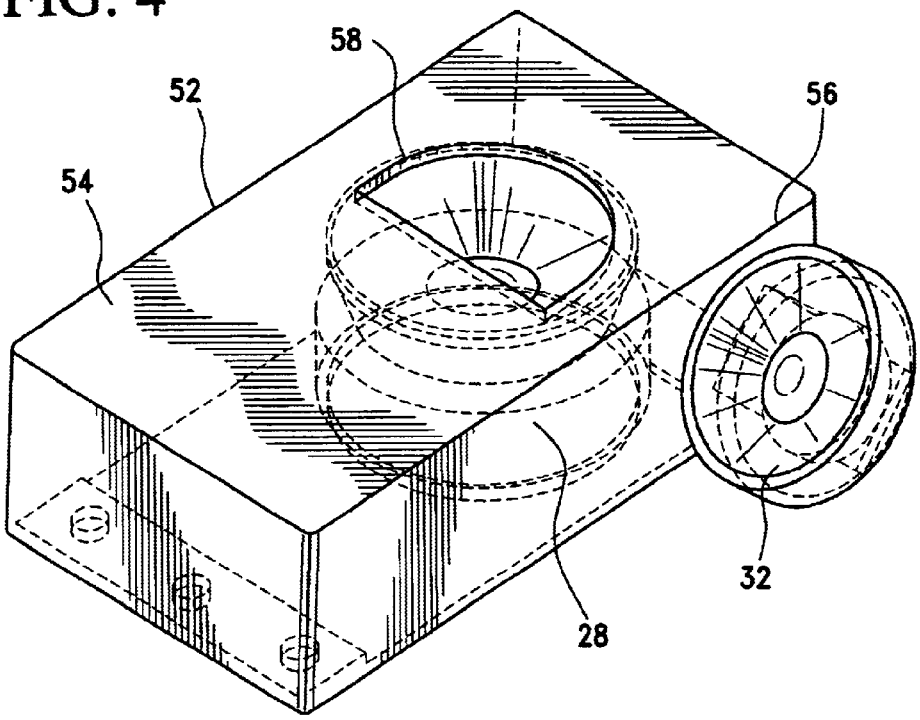
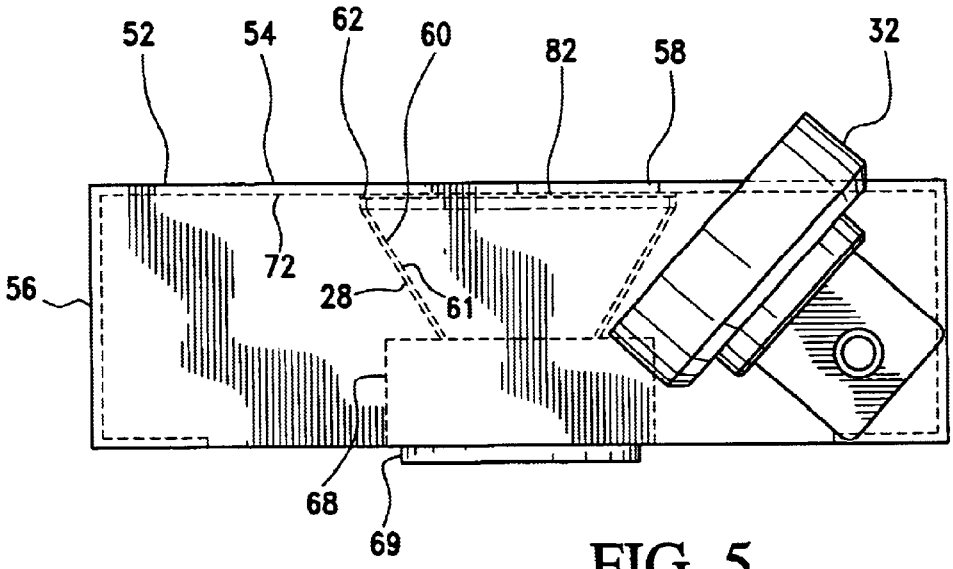
FIG. 5

FIG. 6
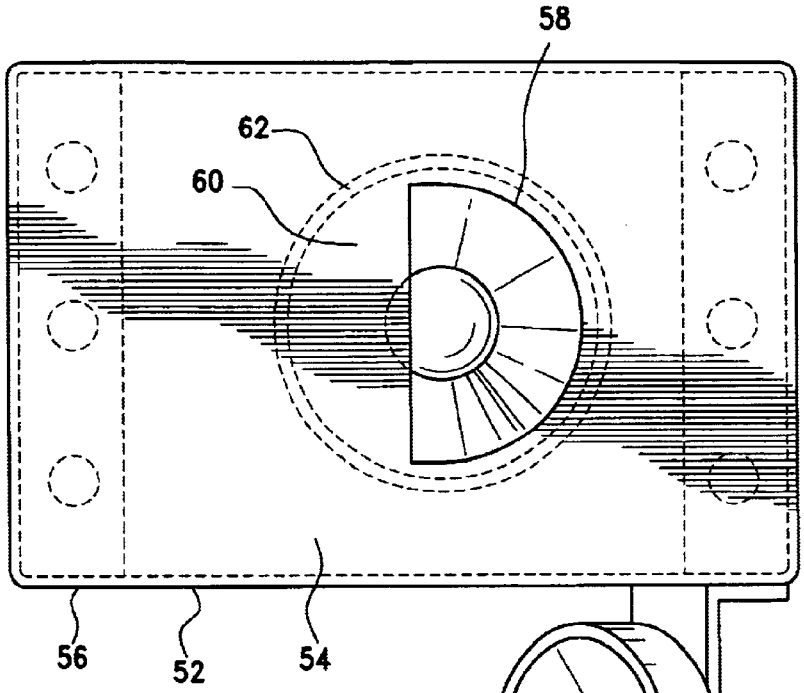
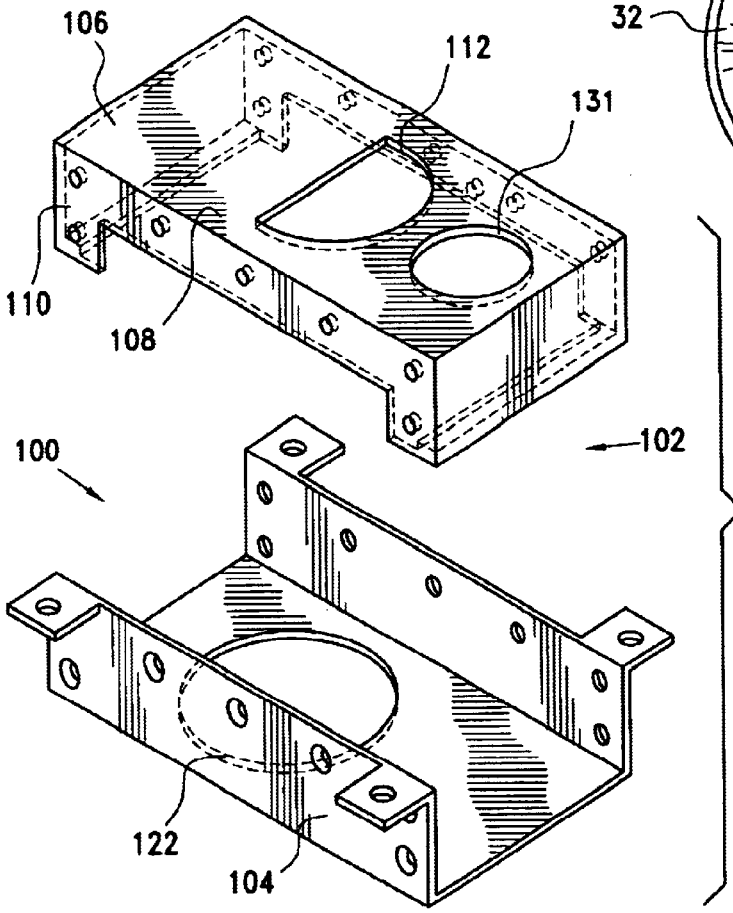
FIG. 7

FIG. 8
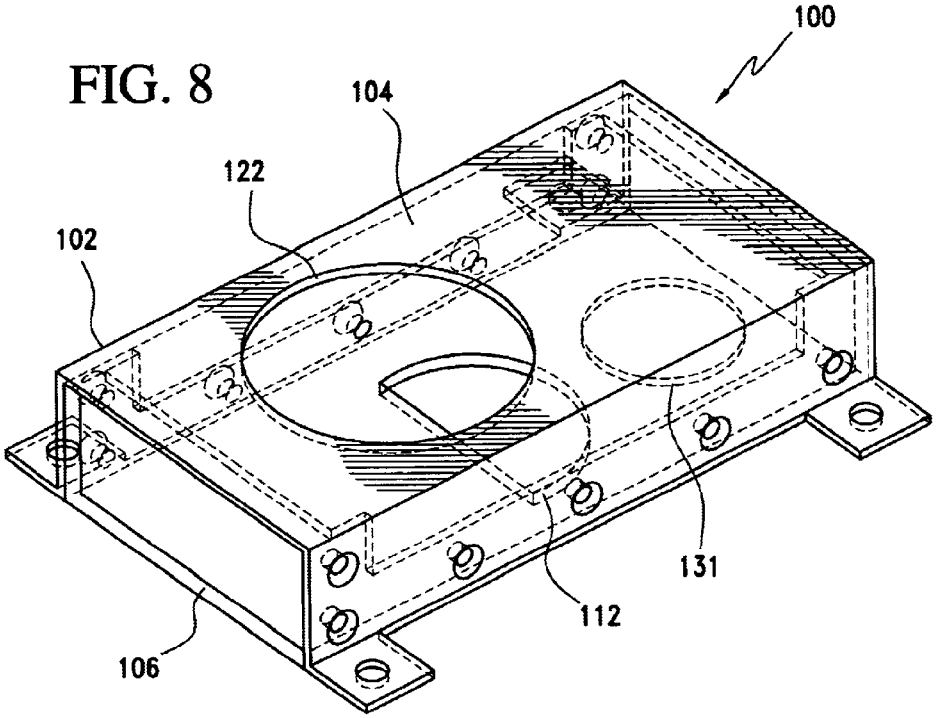
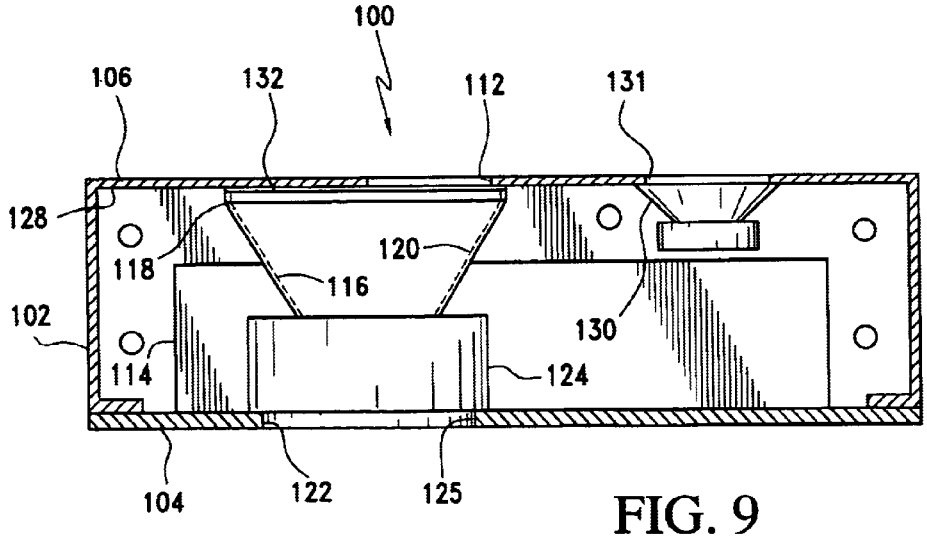
FIG. 9

SPEAKER ASSEMBLY

CROSS REFERENCE TO RELATED APPLICATIONS

This application relates to U.S. Pat. No. 6,279,678 entitled "Speaker Assembly", and issued on Aug. 28, 2001.

BACKGROUND OF THE INVENTION

1. Field of the Invention

The invention relates to a speaker assembly. More particularly, the invention relates to a speaker assembly with reduced size and weight to enhance the performance of the speaker assembly within aircraft.

2. Description of the Prior Art

The current global community has made it possible for people from around the country, and around the world, to interact for both business and personal reasons. For many people, this requires that they spend considerable time traveling from one location to another location. More often than not, these people travel in aircraft.

Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft makes it very difficult to incorporate high fidelity systems within an aircraft. This problem is especially pronounced for audio speaker assemblies when one attempts to meet the size, weight and shape requirements for use in aircraft.

In the aircraft industry great priority is placed upon component weight and size reduction. Range and payload are adversely affected by conventional terrestrial designs. These concerns are notable when one attempts to make changes within smaller private jets. For example, a small increase in the weight carried by an aircraft results in a substantial increase in the fuel consumption of the aircraft. In addition, the limited space available within an aircraft dictates that the use of any space within the aircraft be carefully considered by those responsible for ensuring the comfort of passengers.

Lightweight and compact audio speakers are currently available. These speakers, however, substantially compromise sound quality for reductions in size and weight. An individual wishing to add an audio system to an aircraft must make a choice between high fidelity speakers which do not suit the size and weight requirements of the aircraft and lower quality speakers providing desirable size and weight characteristics.

A need, therefore, exists for a speaker assembly providing high fidelity sound, while also meeting the size and weight requirements of an aircraft. The present invention provides such a speaker assembly.

SUMMARY OF THE INVENTION

It is, therefore, an object of the present invention to provide a speaker assembly including a speaker housing having a closed top wall and an opposed open end. The speaker assembly further includes a first sound source mounted within the speaker housing, wherein a first cover member is positioned over at least a portion of the first sound source to thereby alter the frequency response of the first sound source. The speaker assembly also includes a second sound source mounted within the speaker housing, wherein a second cover member is positioned over at least a portion of the second sound source to thereby alter the frequency response of the second sound source.

It is also an object of the present invention to provide a speaker assembly wherein the first cover member is an acoustic sheet covering the first sound source and the second cover member is an acoustic sheet covering the second sound source.

It is a further object of the present invention to provide a speaker assembly wherein the first sound source is a midrange driver and the second sound source is a midrange driver.

It is another object of the present invention to provide a speaker assembly including a first tweeter positioned adjacent the first sound source and a second tweeter positioned adjacent the second sound source. The first tweeter and the second tweeter are outwardly mounted in opposition to generate a stereo image, wherein the first cover member alters the frequency response of the first sound source in a manner creating a physical crossover network and the second cover member alters the frequency response of the second sound source in a manner creating a physical crossover network.

It is yet another object of the present invention to provide a speaker assembly wherein the first tweeter is mounted between approximately a 25° angle and approximately a 75° angle relative to the opposed open end of the speaker housing and the second tweeter is mounted between approximately a 25° angle and approximately a 75° angle relative to the opposed open end of the speaker housing.

It is still another object of the present invention to provide a speaker assembly including a public address driver.

It is also a further object of the present invention to provide a speaker assembly wherein the first cover member is a first support housing secured to the closed top wall of the speaker housing and the first sound source is positioned between the first support housing and the closed top wall; and the second cover member is a second support housing secured to the closed top wall of the speaker housing and the second sound source is positioned between the second support housing and the closed top wall.

It is also an object of the present invention to provide a speaker assembly wherein the first sound source includes a cone having an interior surface which faces a wall of the first support housing. An exterior upper edge of the cone is directly attached to the wall of the first support housing to seal off a space defined by the interior surface of the cone of the first sound source and the wall of the first support housing. The wall of the first support housing includes a port of a size substantially less than that of the cone such that the wall covers a portion of the first sound source to alter the frequency response of the first sound source. The second sound source includes a cone having an interior surface which faces a wall of the second support housing. An exterior upper edge of the cone is directly attached to the wall of the second support housing to seal off a space defined by the interior surface of the cone of the second sound source and the wall of the second support housing. The wall of the second support housing includes a port of a size substantially less than that of the cone such that the wall covers a portion of the second sound source to alter the frequency response of the first sound source.

It is another object of the present invention to provide a speaker assembly wherein the port of the first support housing is semi-circular and the port of the second support housing is semicircular.

It is still a further object of the present invention to provide a speaker assembly wherein the upper edge of the cone of the first sound source has a radius which is centered in alignment with a radius of the semi-circular port and the upper edge of the cone of the second sound source has a radius which is centered in alignment with a radius of the semi-circular port.

It is also an object of the present invention to provide a loudspeaker assembly including a speaker housing having a first wall and a second wall between which is positioned a sound source. The first wall includes a port through which sound generated by the sound source is directed. The loudspeaker assembly further includes a cover member covering at least a portion of the sound source to alter the resonant characteristics of the sound source, wherein the frequency response altered by covering the sound source creates a physical crossover network. The loudspeaker assembly also includes a tweeter positioned adjacent the sound source, the sound source and tweeter combining to create a predetermined range of frequencies.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a perspective view of the first driver unit.

FIG. 5 is a cross sectional side view of the first driver unit.

FIG. 6 is a top view of the first driver unit.

FIG. 7 is an exploded view of the driver unit housing in accordance with an alternate embodiment.

FIG. 8 is a perspective view of the driver unit housing disclosed in FIG. 7.

FIG. 9 is a cross sectional side view of the driver unit housing disclosed in FIG. 7.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
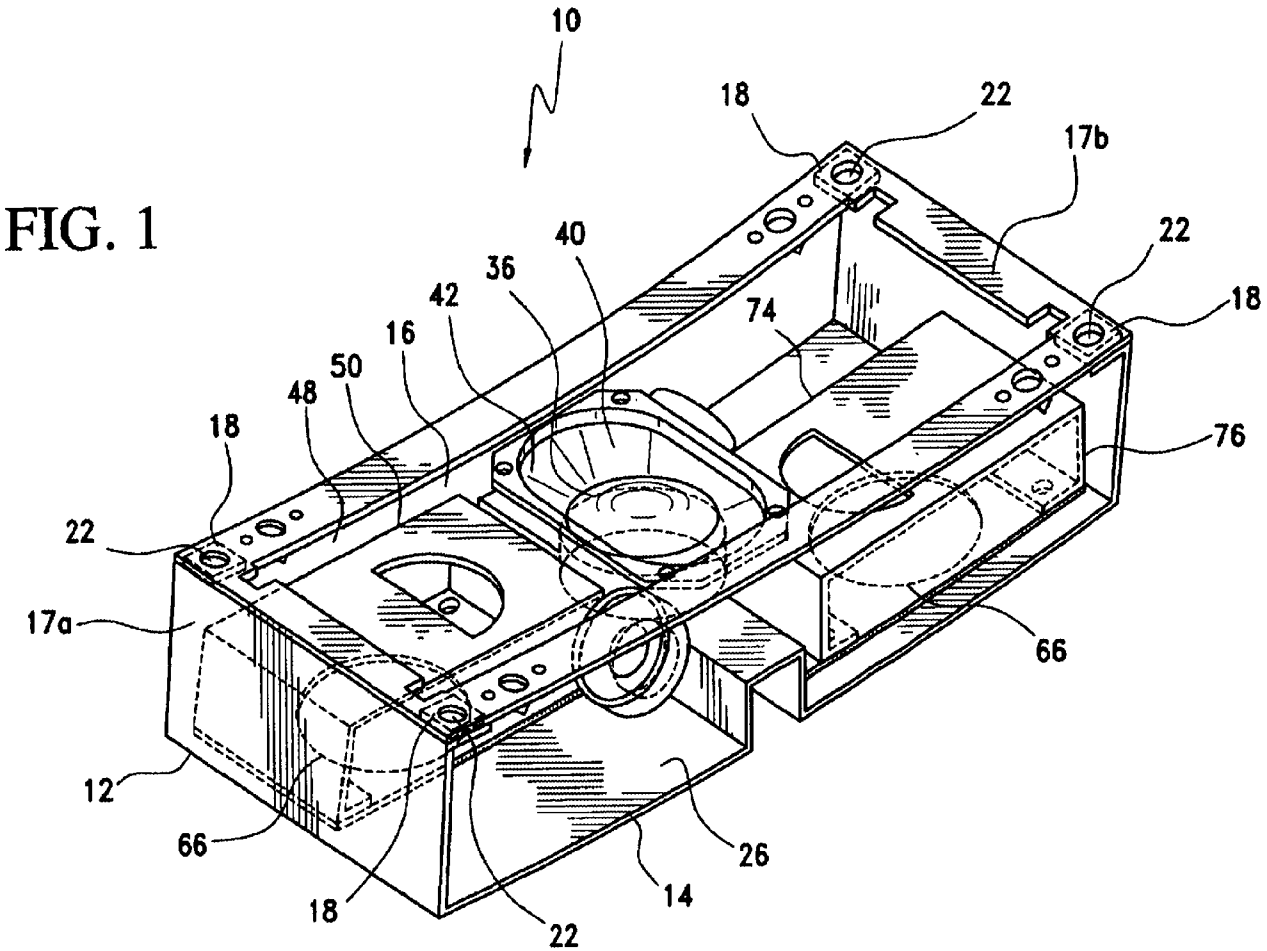
FIG. 1 is a perspective view of the speaker assembly in accordance with the present invention.
Figure 2:
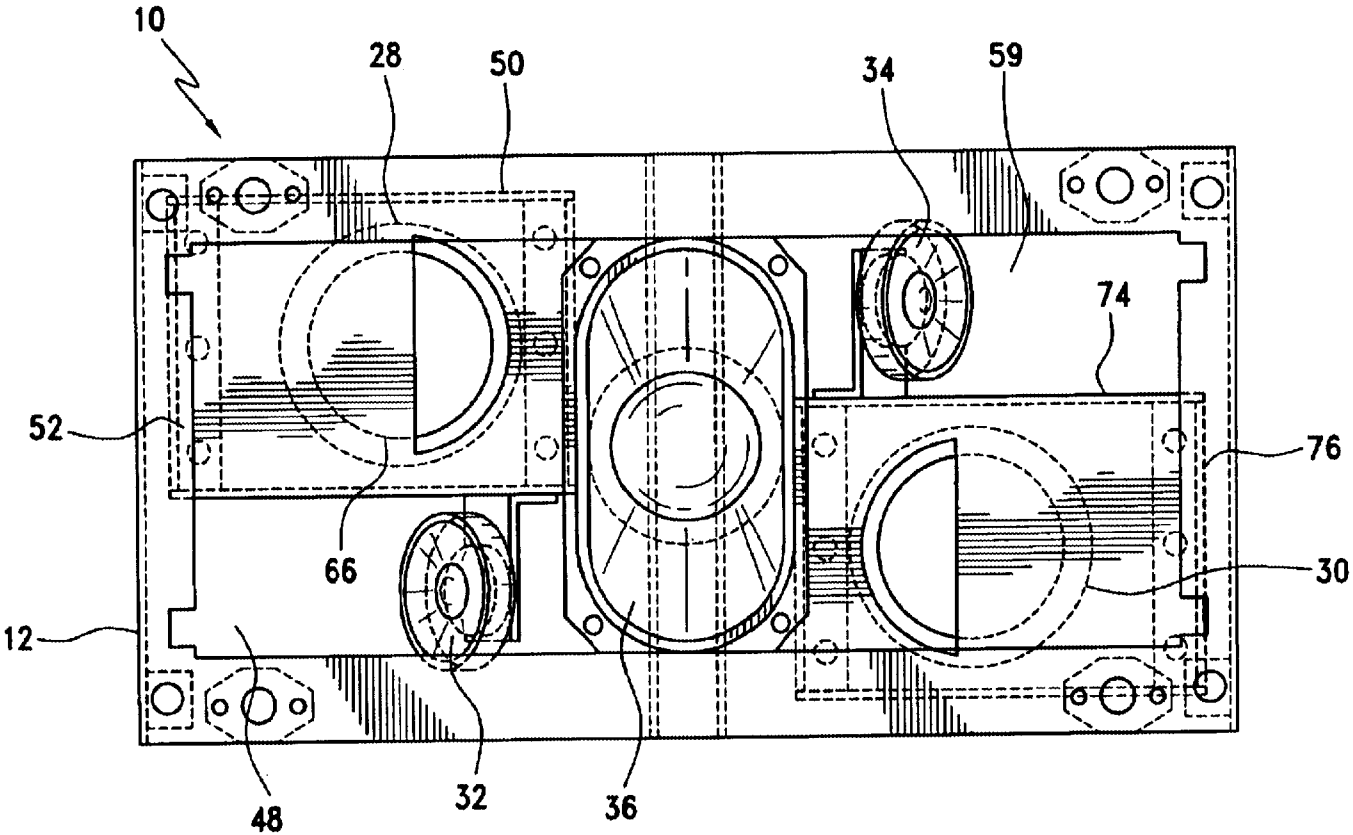
FIG. 2 is a top view of the speaker assembly in accordance with the present invention.
Figure 3:
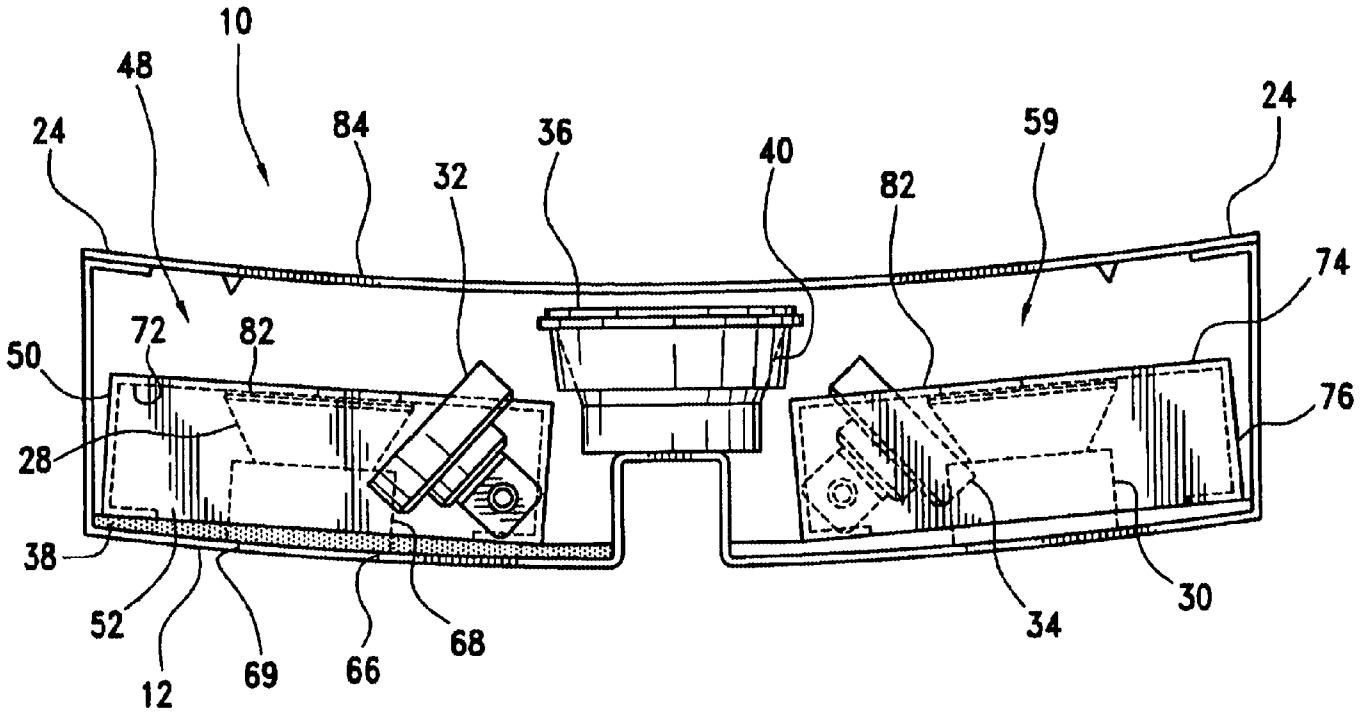
FIG. 3 is a side view of the speaker assembly in accordance with the present invention.

With reference to FIGS. 1 to 3, a low profile speaker assembly 10 is disclosed. The speaker assembly 10 incorporates a variety of features which reduce the size and weight of the speaker assembly 10 without compromising the integrity of the sound generated by the speaker assembly 10. The speaker assembly 10 is primarily intended for use in aircraft, where weight and size are critical. The speaker assembly 10 is designed to extend longitudinally within the center of the cabin. While the speaker assembly 10 is preferably designed for use in aircraft, the speaker assembly 10 may be used in a variety of environments, such as wall enclosed room speakers, automotive speakers or within personal computers, without departing from the spirit of the present invention.

The speaker assembly 10 includes a speaker housing 12 with a closed top wall 14, opposed open end 16 and closed front and rear sidewalls 17*a*, 17*b*. The closed top wall 14 forms a support surface upon which the active speaker components are mounted. The speaker housing 12 is preferably constructed from aluminum, although other materials may be employed without departing from the spirit of the present invention.

In accordance with a preferred embodiment of the present invention, the closed top wall 14 is substantially rectangular, although other shapes may be employed without departing from the spirit of the present invention. Four corner mounts 18 respectively extend from the respective ends of the first and second sidewalls 17*a*, 17*b*. Each corner mount 18 includes an aperture 22 adapted for attaching the speaker assembly 10 within the fuselage of an aircraft.

The corner mounts 18 attach to a mounting bracket (not shown) of the aircraft. The mounting bracket is adapted to facilitate the installation of the present speaker assembly 10 within an aircraft fuselage.

For reasons that will be better appreciate based upon the following disclosure, the sides 26 of the speaker assembly 10 adjacent the active components remain open. The open spaces reduce the weight of the speaker assembly 10, while also reducing sound cancellation to improve the sound quality of the present speaker assembly 10.

With reference to FIGS. 2 and 3, the active components of the speaker assembly 10 include first and second midrange drivers 28, 30, first and second high frequency drivers (i.e., tweeters) 32, 34 and a public address driver 36. The active components are mounted within the speaker housing 12 such that the first midrange driver 28 and the first tweeter 32 are mirror images of the second midrange driver 30 and the second tweeter 34.

With the exception of the public address driver 36, the components are wired to produce stereo sound; that is, the first midrange 28 and tweeter 32 are wired to receive a left channel signal, while the second midrange 30 and tweeter 34 are wired to receive a right channel signal (not shown). The public address driver 36 is distinct from the other active components, and is designed for the transmission of announcement messages commonly issued from the flight crew. While this embodiment is disclosed as providing stereo sound, it is contemplated that the arrangement of components could be varied without departing from the spirit of the present invention.

A sheet of foam insulation 38 (FAA approved for burn test) is secured to the closed top wall 14 of the speaker housing 12 between the active components and the closed top wall 14 of the speaker housing 12. The public address driver 36 is a conventional midrange driver with a cone 40 and is mounted substantially at the center of the speaker housing 12. The cone 40 includes an interior surface 42 which is directed toward the open end 16.

The first midrange driver 28 and first tweeter 32 are mounted along a first side 48 of the closed top wall 14. The first midrange driver 28 and the first tweeter 32 are secured to the closed top wall 14 in a manner forming a first driver unit 50. The first driver unit 50 is composed of the first midrange driver 28 and the first tweeter 32 supported within a first driver unit support housing 52.

With reference to FIGS. 4, 5 and 6, the first driver unit support housing 52 includes a top wall 54 and lateral sidewalls 56 extending downwardly therefrom. As will be discussed below in greater detail, the top wall 54 of the first driver unit support housing 52 includes a port 58 through which sound from the first midrange driver 28 is directed. In accordance with a preferred embodiment of the present invention, the port 58 is semi-circular to enhance the acoustic characteristics of the present speaker assembly 10.

Figure 16:
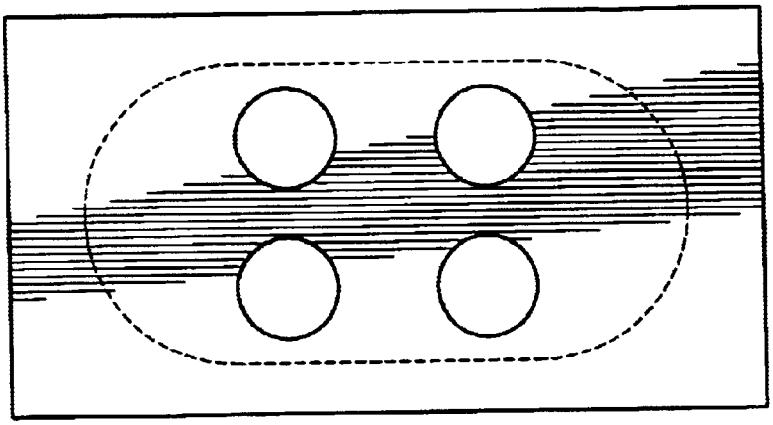
FIGS. 14, 15 and 16 are various alternate embodiments for the port shape in accordance with the present invention.
Figure 15:
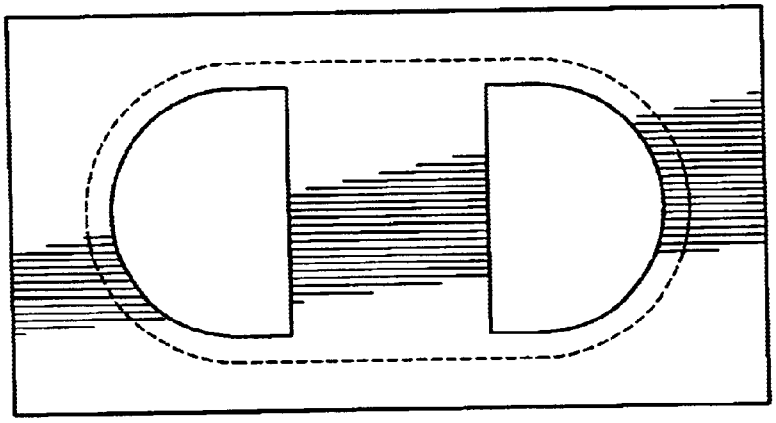
Figure 14:
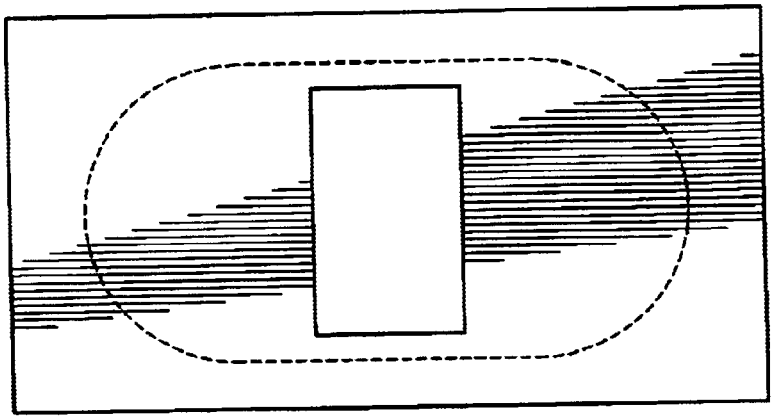

It is contemplated that the port may take a variety of shapes without departing from the spirit of the present invention. For example, and with reference to FIGS. 14, 15 and 16, the port may take the form of a rectangular slot (FIG. 14), dual hemispherical slots (FIG. 15), or an array of similar or dissimilar openings (FIG. 16).

The first driver unit support housing 52 is bolted to the closed top wall 14 forming an enclosure within which the first midrange driver 28 is positioned. The first midrange driver 28 is positioned within the enclosure formed by the first driver unit support housing 52 and the closed top wall 14 such that the interior surface 61 of the cone 60 is directed toward the top wall 54 of the first driver unit support housing 52. In fact, the upper edge 62 of the cone 60 has a radius which is centered in alignment with a radius of the semi-circular port 58.

More specifically, and with reference to FIG. 3, the first midrange driver 28 is compression fit between the closed top wall 14 of the speaker housing 12 and the top wall 54 of the first driver unit support housing 52 such that the interior surface 61 of the cone 60 of first midrange driver 28 faces the top wall 54 of the first driver unit support housing 52. The exterior upper edge 62 of the cone 60 is directly attached to the top wall 54 of the first driver unit support housing 52 to seal off the space defined by the interior surface 61 of the first midrange driver's cone 60.

The compression fit of the first midrange driver 28 within the enclosure defined by the first driver unit support housing 52 and the closed top wall 14 is further enhanced by cutting a driver aperture 66 within the top closed wall 14. The driver aperture 66 is shaped and dimensioned to receive and support the magnet 68 of the first midrange driver 28. The driver magnet 68 of the first midrange driver 28 is seated within the driver aperture 66. Specifically, the closed top wall 14 is cut open in such a way to provide a space in which the back plate 69 of the driver magnet 68 may fit while the remainder of the magnet 68 sits upon a portion of the closed top wall 14 adjacent the driver aperture 66.

The driver magnet 68 of the first midrange driver 28 is wrapped in nonflammable foam (not shown) and is compression fit within the driver aperture 66 to essentially become part of the top closed wall 14. In addition to allowing for the compression fit of the driver magnet 68 within the driver aperture 66, the foam also prevents rattling of components within the first driver unit 50.

By positioning the driver magnet 68 within the closed top wall 14 of the housing 12 space is saved in the profile of the speaker 10. This provides critical additional space for reducing the profile of the present speaker 10. Positioning of the driver magnet 68 within the driver aperture 66 also helps to align the first midrange driver 28 within the first driver unit support housing 52. That is, the first midrange driver 28 is maintained in alignment with the semi-circular port 58. In addition, exposing elements of the driver magnet assembly through the driver aperture 66 provides a desirable heat sink function by exposing elements of the driver magnet assembly to the external environment. While specific dimensions are disclosed in accordance with the present embodiment, the concepts surrounding the present invention maybe applied in various applications without departing from the spirit of the present invention.

As mentioned above, the first midrange driver 28 is compression fit between top wall 54 of the first driver unit support housing 52 and the closed top wall 14. With this in mind, the first midrange driver 28 is shaped and dimensioned to exactly fit between the closed top wall 14 and the top wall 54 of the first driver unit support housing 52, with the magnet 68 of the first midrange driver 28 sitting within the driver aperture 66 formed in the top closed wall 14 of the housing 12. As a result, when the first driver unit support housing 52 is screwed onto the closed top wall 14 of the housing 12, with the first midrange driver 28 sitting therebetween, the inner surface 72 of the first driver unit support housing 52 adjacent the semi-circular port 58 presses against the upper edge 62 of the first midrange driver cone 60 to securely trap the first midrange driver 28 between the closed top wall 14 and the top wall 54 of the first driver unit support housing 52.

The compression fit of the first midrange driver 28 between the closed top wall 14 and the top wall 54 of the first driver unit support housing 52 achieves a weight reduction in that no screws or brackets are required for the mounting of the first midrange driver 28. The closed top wall 14 and the top wall 54 of the first driver unit support housing 52 act as the mounting bracket for the first midrange driver 28. This obviates the need for screws and other mounting structures which ultimately reduces the weight and complexity of the present speaker assembly.

In addition to reducing the profile and weight of the present loudspeaker assembly 10, the present design improves the structural integrity of the speaker assembly 10. By compression fitting the first midrange driver 28 between the driver aperture 66 of the closed top wall 14 and the top wall 54 of the first driver unit support housing 52 as discussed above, the first midrange driver 28 becomes part of the internal bracing of the first driver unit 50 and adds to the structural stability of the loudspeaker assembly 10. The exposed magnet 68 also provides a natural heat sink for cooling the first midrange driver 28.

The first tweeter 32 is mounted adjacent the first midrange driver 28 by securing the tweeter 32 to a sidewall 56 of the first driver unit support housing 52. The exact positioning of the tweeter 32 along the sidewall 56 of the first unit support housing 52 maybe varied to suit specific needs without departing from the spirit of the present invention. The tweeter 32 is obliquely secured to the first driver unit support housing 52 to create a stereo image when the first driver unit 50 is combined with the second driver unit 74 (and consequently the obliquely oriented second tweeter 34). More specifically, the first tweeter 32 is mounted such that it faces away from the closed top wall 14. The first tweeter 32 is also positioned in an opposed relationship with the second tweeter 34 to enhance the stereo separation produced by the present speaker assembly 10.

As with the first midrange driver 28 and first tweeter 32, the second midrange driver 30 and second tweeter 34 are mounted along a second side 59 of the closed top wall 14. The second midrange driver 30 and the second tweeter 34 are secured to the closed top wall 14 in a manner forming a second driver unit 74. Specifically, the second driver unit 74 is composed of the second midrange driver 30 and the second tweeter 34 supported within a second driver unit support housing 76.

The second driver unit 74 is substantially a mirror image of the first driver unit 50 and the details thereof will not be repeated herein. As such, reference should be made to the preceding disclosure relating to the first driver unit 50.

The first tweeter 32 and the second tweeter 34 are respectively mounted on opposite sides of the speaker housing 12, producing a true stereo image with minimal "footprint" (that is, a true stereo image is produced with the use of minimal space).

As stated above, the first tweeter 32 receives a left channel of a stereo signal and the second tweeter 34 receives a right channel of a stereo signal. Although the first and second tweeters 32, 34 are closely mounted within a single speaker housing 12, a stereo image is produced by outwardly mounting the tweeters in opposition. Specifically, the tweeters are mounted between approximately a 25° angle and a 75° angle relative to the plane of the opposed open end 16, and preferably at approximately a 45° angle relative to the plane of the opposed open end 16. In addition, the lateral orientation of the tweeters 32, 34 may be varied, although the preferred embodiment employs a lateral orientation of 45° relative to a plane extending from the first long side 78 of the speaker housing 12 to the second long side 50 of the speaker housing 12. While a specific orientation for the tweeters is disclosed in accordance with a preferred embodiment of the present invention, the tweeters may be oriented in various configurations (for example, coplanar) without departing from the spirit of the present invention.

The semi-circular ports 58, through which sound is respectively directed by the first and second midrange drivers 28, 30, work in combination with acoustic sheets 82, for example, woven fabric sheets, covering the cones 60 of the first and second midrange drivers 28, 30 to create a physical crossover (i.e., a physical, as opposed to electrical, mechanism for filtering undesired frequencies such that the driver only provides those frequencies within a predetermined range while moderating anomalies in the frequency response curve to produce clearer more natural sound. More specifically, and in accordance with the preferred embodiment of the present invention, the acoustic sheets 82 covering the cones 60 of the first and second midrange drivers 28, 30 are woven fabric acoustic sheets applied to the cone upper edges 62 with adhesive, and between the cone upper edges 62 and the top wall 54 of the driver unit support housings 50, 80 The woven fabric acoustic sheets 82 function to attenuate the higher frequency sounds generated by the first and second midrange drivers 28, 30. In this way, the high frequency sound is only transmitted by the first and second tweeters 32, 34, thereby improving upon the directionality of the resulting sound. While a woven fabric acoustic sheet is utilized in accordance with a preferred embodiment of the present invention, other natural or synthetic cover materials may be used in accordance with the present invention. For example, it is contemplated that open cell or closed cell foam sheets, other woven fabrics (for example, silk), nonwoven fabrics (e.g., fleece) and plastics may be used in attenuating the various frequency sounds generated by the midrange drivers.

In addition to the attenuation of high frequency sounds by the acoustic sheets 82, the semicircular ports 58 further attenuate the sound being generated by the midrange drivers 28, 30. Specifically, by covering a portion of each midrange driver 28, 30 with the closed top wall 14, sound generated by the midrange drivers 28, 30 is reflected within the enclosure, resulting in phase cancellation, absorption and attenuation of the sound prior to it passing through the semicircular ports 58. The resulting phase cancellation, absorption and attenuation mitigate the amplitude of undesirable mid-range frequencies, producing a clearer, more accurate sound.

The inclusion of the acoustic sheets 82 over the cones 60 of the midrange drivers 28, 30 in combination with the semi-circular ports 58 function to improve the frequency response of the sound emitted from the drivers 28, 30. Specifically, the acoustic sheets 82 and semi-circular ports 58 limit the passage of specific frequencies, while permitting other frequencies from passing therethrough. The acoustic sheets 82 and semi-circular ports 58 also improve phase cancellation and resonant characteristics associated with the midrange drivers 28, 30. In this way, the acoustic sheets 82 and semi-circular ports 58 function as a physical crossover, obviating the need for the use of a traditional electrical based crossover network. The acoustic sheets 82 and semi-circular ports 58 generally function as an acoustic lens, reflecting and phase canceling some frequencies and absorbing other frequencies. The acoustic output of the midrange drivers 28, 30 is also attenuated by the crossover, allowing for appropriate level matching with the tweeters 32, 34 without resorting to "padding" resistors (which further provides a weight and space savings).

The removal of a traditional electronic crossover network from the present speaker assembly results in a dramatic weight and size reduction. Specifically, speaker assemblies in accordance with the present invention have been manufactured with a weight as little as 1 lb. 1 oz. In addition to reducing the weight of the present speaker assembly, the physical crossover network simplifies the design and manufacture, while also reducing cost.

The removal of the traditional electronic crossover network also results in an increase in efficiency. Specifically, the use of inductors and capacitors within a traditional electronic crossover network drains the current being transmitted to the various drivers. Removal of these components within the present speaker design, lessens the burdened imposed by these electronic components and allows greater efficiency in the current actual used in the driving the various drivers.

Installation of the speaker assembly is completed by mounting the speaker assembly 10 at a desired location such that the opposed open end 16 of the speaker assembly 10 is directed toward the listening environment and the closed top wall 14 of the speaker housing 12 is directed away from the listening environment. Once the speaker assembly 10 is properly mounted, an expanded metal/perforated speaker grill 84 is placed over the opposed open end 16 of the speaker assembly 10 to hide the contents of the speaker assembly 10 and protect the acoustic components found within the speaker housing 12. The speaker grill 84 is secured to the mounting bracket 24 by a hook and loop fastening, although the speaker grill 84 may be secured to the speaker housing 12 in a variety of manners without departing from the spirit of the present invention. In addition, the speaker grill 84 maybe secured on the speaker housing 12 prior to installing the speaker assembly 10 at a desired location. The speaker grill 84 should be designed such that it limits interference with sound generated by the tweeters 32, 34 to ensure a high quality stereo sound field.

Figure 13:
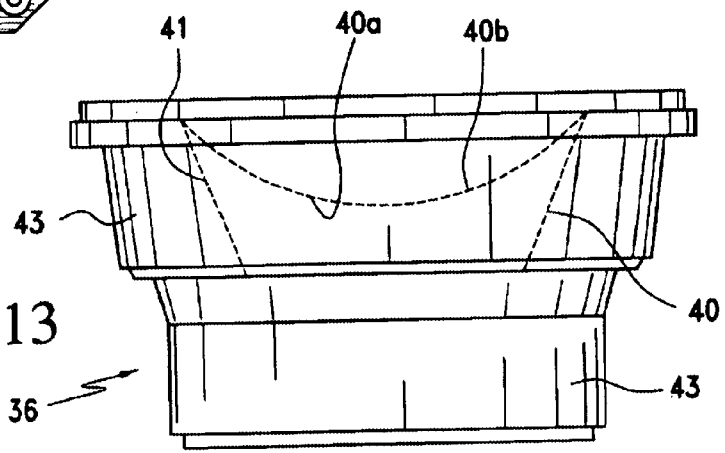
FIG. 13 is an end view of the public address driver in accordance with the present invention.

Efficiency of the present speaker assembly 10 is achieved by enclosing the speaker basket 41 of the public address driver 36. Specifically, and with reference to FIG. 13, the public address driver 36 includes a cone 40 having a magnet 43 secured thereto in a traditional manner. The driver 36 is also provided with a traditional speaker basket 41 surrounding and supporting the convex second side 40*a* of the cone 40, while the concave first side 40*b* of the cone 40 is positioned for emitting sound therefrom. The speaker basket 41 is, however, covered 43 so as to substantially enclosure that portion of the cone 40 facing the speaker basket framework.

The embodiment disclosed in FIGS. 1, 2 and 3 is designed for placement in the space within an aircraft designed for an oxygen box, and is 4.2"wide, 8.25"long, and 1.5"deep. The speaker assembly 10 also weighs only 1 lb. 9 oz. and has a radius of curvature of shaped to conform with the space in which it must fit.

The first and second driver units 50, 74 have been described above for use together in a single speaker assembly. However, these driver units may be used separately as independent, spaced loudspeakers providing a single midrange driver and tweeter. With reference to FIGS. 7, 8 and 9, such an embodiment is disclosed.

The loudspeaker 100 includes a support housing 102. The support housing 102 is composed of a first housing member 104, which substantially replaces the closed top wall 14 of the embodiment described with reference to FIGS. 1 to 6, and a second housing member 106, which is substantially similar to the driver unit support housing 52 described with reference to FIGS. 1 to 6.

The second housing member 106 includes a top wall 108 and lateral sidewalls 110 extending downwardly therefrom. The top wall 108 of the second housing member 106 includes a port 112 through which sound from a midrange driver 114 is directed. In accordance with a preferred embodiment of the present invention, the port 112 is semi-circular to enhance the acoustic characteristics of the present loudspeaker 100.

The second housing member 106 is bolted to the first housing member 104, forming an enclosure within which the midrange driver 114 is positioned. The midrange driver 114 is positioned within the enclosure formed by the second housing member 106 such that the cone 116 of the midrange driver 114 is directed toward the top wall 108 of the second housing member 106. In fact, the upper edge 118 of the cone 116 has a radius which is centered in alignment with a radius of the semi-circular port 112.

The midrange driver 114 is compression fit between the first housing member 104 of the support housing 102 and the top wall 108 of the second housing member 106 such that the interior surface 120 of the cone 116 of the midrange driver 114 faces the top wall of the second housing member 106. The exterior upper edge 118 of the cone 116 is directly attached to the top wall 108 of the second housing member 108 to seal off the space defined by the interior surface 120 of the cone 116 of the midrange driver 114.

The compression fit of the midrange driver 114 within the enclosure defined by the support housing 102 is further enhanced by cutting a driver aperture 122 within the first housing member 104. The driver aperture 122 is shaped and dimensioned to receive and support the magnet 124 of the midrange driver 114. As shown in FIG. 9, the driver magnet 124 of the midrange driver 114 is seated within the driver aperture 122 formed in the first housing member 104. Specifically, the first housing member 104 is cut open in such a way that it provides a space in which the back plate 125 of the driver magnet 124 may fit while the remainder of the magnet 124 sits upon a portion of the first housing member 104 adjacent the driver aperture 122.

The driver magnet 124 of the midrange driver 114 is wrapped in nonflammable foam (not shown) and is compression fit within the driver aperture 122 to essentially become part of the first housing member 104. In addition to allowing for the compression fit of the driver magnet 124 within the driver aperture 122, the foam also prevents rattling of components within the support housing 102.

As mentioned above, the midrange driver 114 is compression fit between top wall 108 of the second housing member 106 and the first housing member 104. With this in mind, the midrange driver 114 is shaped and dimensioned to exactly fit between the first housing member 102 and the top wall 108 of the second housing member 106, with the midrange driver 114 sitting within the driver aperture 122 formed in the first housing member 104 of the support housing 102. As a result, the first and second housing members 104, 106 are screwed together with the midrange driver 114 sitting therebetween. In this way, the inner surface 128 of the second housing member 106 adjacent the semi-circular port 112 presses against the upper edge 118 of the midrange driver cone 116 to securely trap the midrange driver 114 between the first housing member 104 and the top wall 108 of the second housing member 106.

The compression fit of the midrange driver 114 between the first housing member 104 and the top wall 108 of the second housing member 106 achieves a weight reduction in that no screws or brackets are required for the mounting of the midrange driver 114. The first housing member 104 and the top wall 108 of the second housing member 106 act as the mounting bracket for the midrange driver 114, thereby, obviating the need for screws and other mounting structures.

In addition to reducing the profile of the present loudspeaker 100, the present design improves the structural integrity of the loudspeaker 100. By compression fitting the midrange driver 114 between the driver aperture 122 of the first housing member 104 and the top wall 108 of the second housing member 106 as discussed above, the midrange driver 114 becomes part of the internal bracing of the loudspeaker 100 and adds to the structural stability of the loudspeaker 100. As discussed with reference to the prior embodiment, the present design also provides a natural heat sink for cooling the microwoofer.

The tweeter 130 is secured adjacent a tweeter port 131 formed in the second housing member 106.

As with the embodiment disclosed with reference to FIGS. 1 to 6, the inclusion of the semi-circular port 112 through which sound is respectively directed by the midrange driver 114 works in combination with a acoustic sheet 132 covering the cone 116 of the midrange driver 114 to create a physical crossover. More specifically, in accordance with the preferred embodiment of the present invention, the acoustic sheet 132 covering the cone 116 of the midrange driver 114 is a woven wool fabric sheet applied to the cone upper edge 118 with adhesive, and between the cone upper edge 118 and the top wall 108 of the second housing member 106.

The inclusion of the acoustic sheet 132 over the cone 116 of the midrange driver 114 in combination with the semi-circular port 112 also functions to improve the frequency response of the sound emitted from the driver 114. Specifically, the acoustic sheet 132 and semi-circular port 112 limit the passage of specific frequencies, while permitting other frequencies from passing therethrough. The acoustic sheet 132 and semi-circular port 112 also improve phase cancellation and resonant characteristics associated with the midrange driver 114. In this way, the acoustic sheet 132 and semi-circular port 112 function as a physical crossover and obviate the need for the use of a traditional crossover network.

Figures 10, 11:
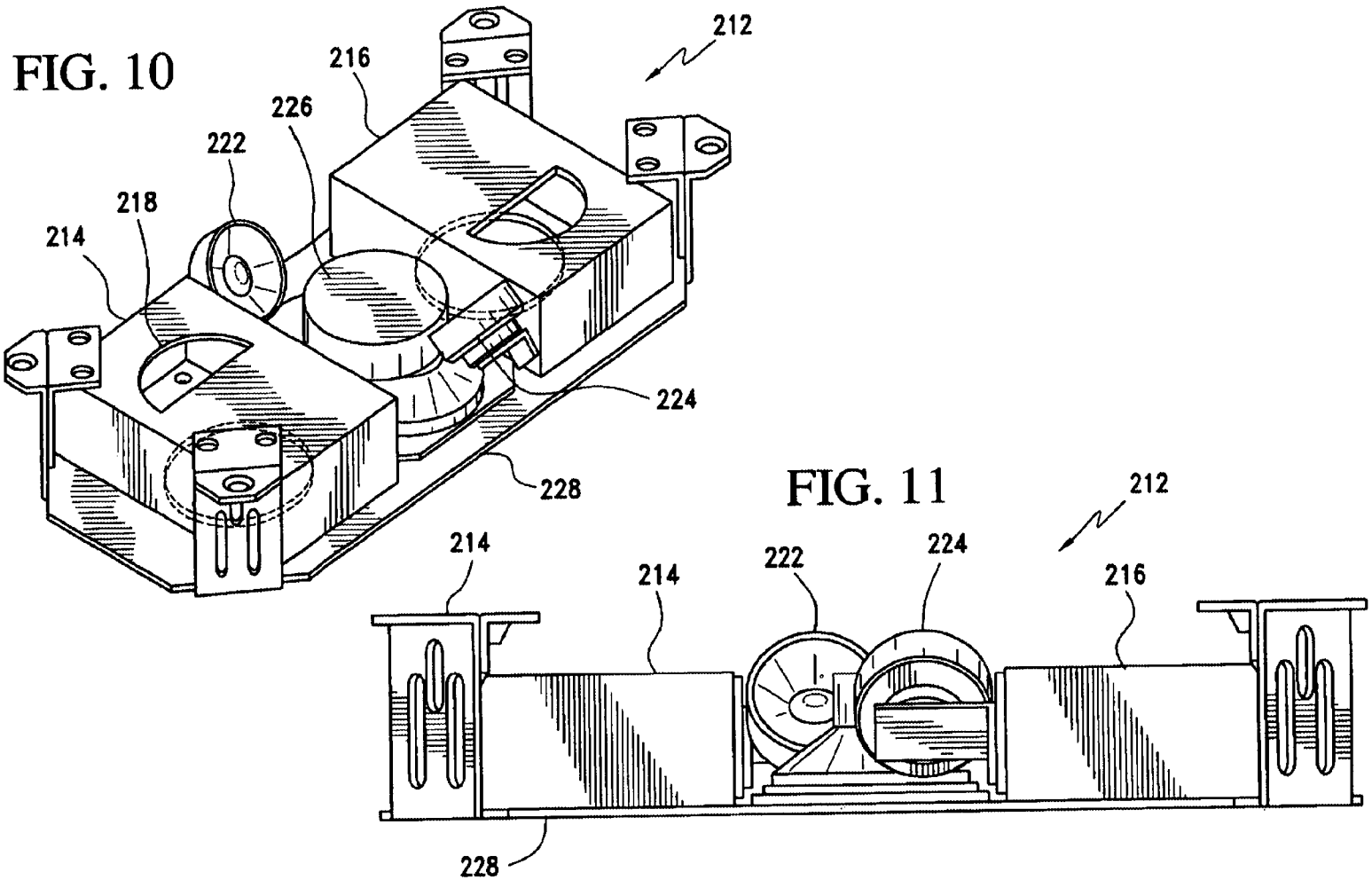
FIG. 10 is a perspective view of an alternate embodiment of the speaker assembly.
FIG. 11 is a side view of the alternate embodiment disclosed in FIG. 10.
Figure 12:
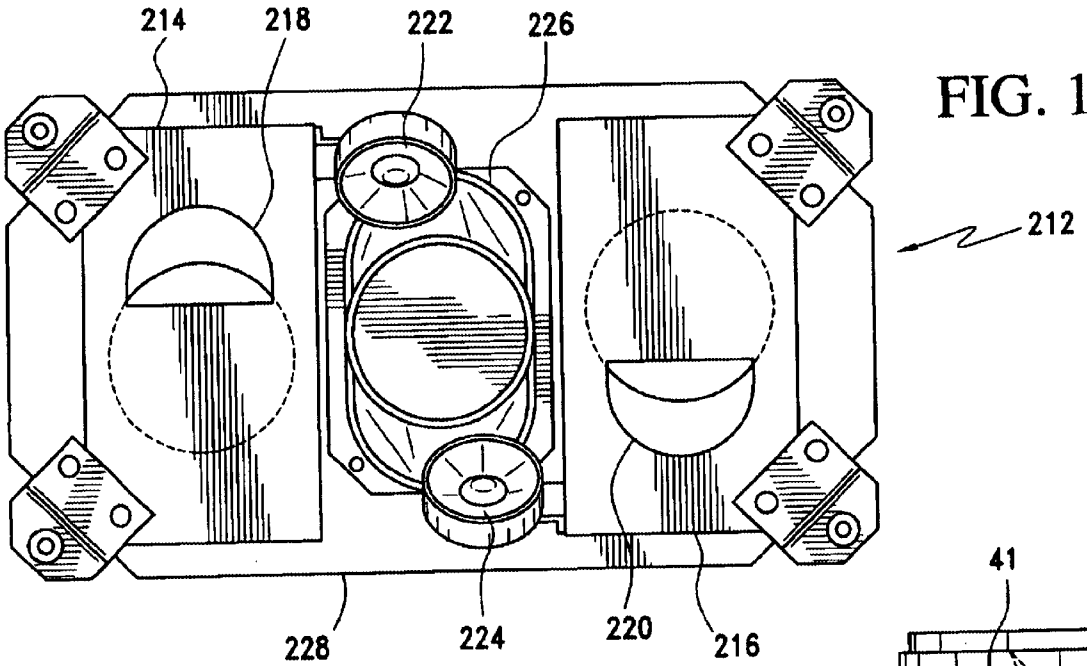
FIG. 12 is a top view of the speaker assembly disclosed in FIG. 10.

Those skilled in the art will certainly appreciate the variety of orientation in which the components of the speaker assembly described above may be positioned without departing from the spirit of the present invention. For example, and with reference to FIGS. 10, 11 and 12, a housing 212 such as that used in conjunction with commonly owned U.S. patent application Ser. No. 09/650,188, entitled "SPEAKER ASSEMBLY", which is incorporated herein by reference, may be used in conjunction with driver units 214, 216 such as those described above with reference to FIGS. 1 to 6. In accordance with this embodiment, the driver units 214, 216 are substantially aligned (with the exception that the port 218, 220 and tweeter 222, 224 positions are reversed to provide for a stereo image) and the public address driver 226 is positioned therebetween. In order to ensure the desired space and profile savings, the public address driver 226 is positioned facing the closed wall 228 of the housing 212 in the manner described in the '188 application. It is further contemplated that other design variations are possible without departing from the spirit of the present invention.

While the preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A speaker assembly, comprising:

a speaker housing having a closed top wall and an opposed open end;

a first sound source mounted within the speaker housing, wherein a first cover member is positioned over at least a portion of the first sound source to thereby alter the frequency response of the first sound source and the first cover member is a first support housing secured to the closed top wall of the speaker housing and the first sound source is positioned between the first support housing and the closed top wall, the first sound source being compression fit between the speaker housing and the first cover member such that the first sound source contacts the speaker housing and the first sound source contacts the first cover member with compressive force being applied to the first sound source by the speaker housing and first cover member;

a second sound source mounted within the speaker housing, wherein a second cover member is positioned over at least a portion of the second sound source to thereby alter the frequency response of the second sound source and the second cover member is a second support housing secured to the closed top wall of the speaker housing and the second sound source is positioned between the second support housing and the closed top wall, the second sound source being compression fit between the speaker housing and the second cover member such that the second sound source contacts the speaker housing and the second source contacts the second cover member with compressive force being applied to the second sound source by the speaker housing and second cover member; and wherein the first cover member and the second cover member respectively alter the frequency response of the first sound source and the second sound source in a manner creating a physical crossover network.

2. The speaker assembly according to claim 1, wherein the first cover member is an acoustic sheet covering the first sound source and the second cover member is an acoustic sheet covering the second sound source.

3. The speaker assembly according to claim 1, wherein the first sound source is a midrange driver and the second sound source is a midrange driver.

4. The speaker assembly according to claim 1, further including a first tweeter positioned adjacent the first sound source and a second tweeter positioned adjacent the second sound source, the first tweeter and the second tweeter are outwardly mounted in opposition to generate a stereo image.

5. The speaker assembly according to claim 4, wherein the first tweeter is mounted between approximately a 25° angle and approximately a 75° angle relative to the opposed open end of the speaker housing and the second tweeter is mounted between approximately a 25° angle and approximately a 75° angle relative to the opposed open end of the speaker housing.

6. The speaker assembly according to claim 1, further including a public address driver.

7. The speaker assembly according to claim 1, wherein the first sound source includes a cone having an interior surface which faces a wall of the first support housing, an exterior upper edge of the cone being directly attached to the wall of the first support housing to seal off a space defined by the interior surface of the cone of the first sound source and the wall of the first support housing, the wall of the first support housing including a port of a size substantially less than that of the cone such that the wall covers a portion of the first sound source to alter the frequency response of the first sound source; and the second sound source includes a cone having an interior surface which faces a wall of the second support housing, an exterior upper edge of the cone being directly attached to the wall of the second support housing to seal off a space defined by the interior surface of the cone of the second sound source and the wall of the second support housing, the wall of the second support housing including a port of a size substantially less than that of the cone such that the wall covers a portion of the second sound source to alter the frequency response of the first sound source.

8. The speaker assembly according to claim 7, wherein the port of the first support housing is semi-circular and the port of the second support housing is semicircular.

9. The speaker assembly according to claim 8, wherein the upper edge of the cone of the first sound source has a radius which is centered in alignment with a radius of the semi-circular port and the upper edge of the cone of the second sound source has a radius which is centered in alignment with a radius of the semi-circular port.

10. A loudspeaker assembly, comprising:

a speaker housing having a first wall and a second wall between which is positioned a sound source;

the second wall including a port through which sound generated by the sound source is directed;

a cover member covering at least a portion of the sound source to alter the resonant characteristics of the sound source, wherein the cover member is a port formed in the second wall, the port being of a size substantially less than the sound source such that the second wall covers a substantial portion of the sound source;

a tweeter positioned adjacent the sound source, the sound source and tweeter combining to create a predetermined full range of sounds;

wherein the frequency response altered by the cover member and the port creates a physical crossover network.

11. The speaker assembly according to claim 10, wherein the cover member further includes an acoustic sheet which covers at least a portion of the sound source.

12. The speaker assembly according to claim 11, wherein the sound source includes a cone having an interior surface which faces the second wall of the speaker housing, an exterior upper edge of the cone being directly attached to the second wall of the speaker housing to seal off a space defined by the interior surface of the cone of the sound source and the second wall of the speaker housing, the port being of a size substantially less than that of the cone such that the second wall covers a portion of the sound source to alter the frequency response of the sound source.

13. The speaker assembly according to claim 12, wherein the port is semi-circular.

14. The speaker assembly according to claim 13, wherein the upper edge of the cone of the sound source has a radius which is centered in alignment with a radius of the semi-circular port.

15. The speaker assembly according to claim 10, wherein the sound source is a midrange driver.

16. The speaker assembly according to claim 10, wherein the port is of a size substantially less than the sound source such that the second wall covers a substantial portion of the sound source.

17. The speaker assembly according to claim 10, wherein the sound source includes a cone having an interior surface which faces the second wall of the speaker housing, an exterior upper edge of the cone being directly attached to the second wall of the speaker housing to seal off a space defined by the interior surface of the cone of the sound source and the second wall of the speaker housing, the port being of a size substantially less than that of the cone such that the second wall covers a portion of the sound source to alter the frequency response of the sound source.

18. The speaker assembly according to claim 10, wherein the port is semi-circular.

* * * * *